United States Patent [19]

Wallen

[11] 4,017,091

[45] Apr. 12, 1977

[54] GOLF CART

[76] Inventor: Russell J. Wallen, 1800 Hayes St. NE., Minneapolis, Minn. 55418

[22] Filed: June 30, 1975

[21] Appl. No.: 591,301

[52] U.S. Cl. ..... 280/30; 280/DIG. 6; 280;47.37 R/; 280/47.26

[51] Int. Cl.[2] ..... B62B 1/04

[58] Field of Search ..... 280/30, DIG. 6, 37, 280/47.37, 47.26, 645, 651, 652, 655

[56] References Cited

UNITED STATES PATENTS

| | | | |
|---|---|---|---|
| 1,581,061 | 4/1926 | Johnston | 280/DIG. 6 |
| 2,024,484 | 12/1935 | Smith | 28/DIG. 6 |
| 2,590,178 | 3/1952 | Jamison | 280/37 |
| 2,602,676 | 7/1952 | Fieldhouse | 280/DIG. 6 |
| 2,681,232 | 6/1954 | Womack | 280/DIG. 6 |
| 2,701,725 | 2/1955 | MeikleJohn | 280/DIG. 6 |
| 2,726,874 | 12/1955 | Sullivan | 280/37 |
| 2,760,782 | 8/1956 | Hartzell | 280/37 |
| 2,783,054 | 2/1957 | Stratton, Jr. | 280/DIG. 6 |
| 2,902,287 | 9/1959 | Elias | 280/DIG. 6 |
| 2,911,228 | 11/1959 | Green | 280/DIG. 6 |
| 3,096,992 | 7/1963 | Fritsch | 280/47.26 X |
| 3,147,022 | 9/1964 | Amendola | 280/37 |
| 3,164,393 | 1/1965 | Upham | 280/DIG. 6 |
| 3,738,677 | 6/1973 | Renock | 280/37 |
| 3,810,649 | 5/1974 | Fahey, Jr. | 280/37 |
| 3,900,209 | 8/1975 | McDonnell | 280/DIG. 6 |

FOREIGN PATENTS OR APPLICATIONS

| | | | |
|---|---|---|---|
| 469,642 | 3/1948 | Canada | 280/DIG. 6 |
| 618,275 | 3/1927 | France | 280/37 |
| 801,883 | 12/1950 | Germany | 280/37 |

*Primary Examiner*—Joseph F. Peters, Jr.
*Assistant Examiner*—J. D. Rubenstein
*Attorney, Agent, or Firm*—Merchant, Gould, Smith, Edell, Welter & Schmidt

[57] ABSTRACT

A convertible golf cart which can be wheeled over a golf course carrying golf equipment and can be readily disassembled for transportation and storage. Detachable wheels and a retracting-removable handle and support strut serve to convert the golf cart from its operating condition to a storage and transport condition.

5 Claims, 13 Drawing Figures

GOLF CART

BACKGROUND OF THE INVENTION

1. Field of the Invention

The present invention relates generally to a cart for golfing equipment and more specifically to a convertible golf cart which is readily converted from an operating condition to a storage and transport condition.

2. Prior Art

A variety of wheeled golf carts are described in the prior art. Golf carts have been provided with removable wheels which can be stored on or in the cart. Further, golf carts have been provided with closeable cases and carrying handles as well as detachable wheels to permit the cart to serve also as an equipment storage device. Various prior art golf carts have described one and two wheeled designs.

These types of carts have been disclosed in U.S. Pat. Nos. 1,581,061, issued to Johnston on Apr. 13, 1926; 2,551,009, issued to Kaltenbach on May 1, 1951; 2,726,874, issued to Sullivan on Dec. 13, 1955; 3,096,992, issued to Fritsch on July 9, 1963; and 3,738,677, issued to Renock on June 12, 1973. The present invention is an improvement to this type of golf cart.

Prior art golf carts have generally been bulky and heavy. Such a cart is very difficult to transport to and from the golf course. Other smaller and less heavy carts have not provided the capacity to carry a full assortment of golfing equipment. Further, other convertible golf carts have required considerable time and energy in assembly and disassembly. Other such carts have required utilization of a substantial number of independent parts in construction and subsequent use of the cart. In short, no prior art device achieves the need for a convertible cart which is lightweight, durable, easily assembled and disassembled, and which forms and integrated package for all component parts thereof. The present invention achieves the aforementioned needs and provides a novel and superior device.

SUMMARY OF THE INVENTION

According to the present invention, the convertible golf cart comprises a lightweight, durable body which is designed to include integrated compartments formed within the body of the cart for carrying golf equipment, such as gold clubs, tees, and balls. The cart body is provided with snap-off wheels and an integrated recess formed within the body for snap-in storage of the wheels. A support strut and handle are further provided on the cart with each having a corresponding integrated storage position on the cart body.

DETAILED DESCRIPTION OF THE DRAWINGS

Figure 1:
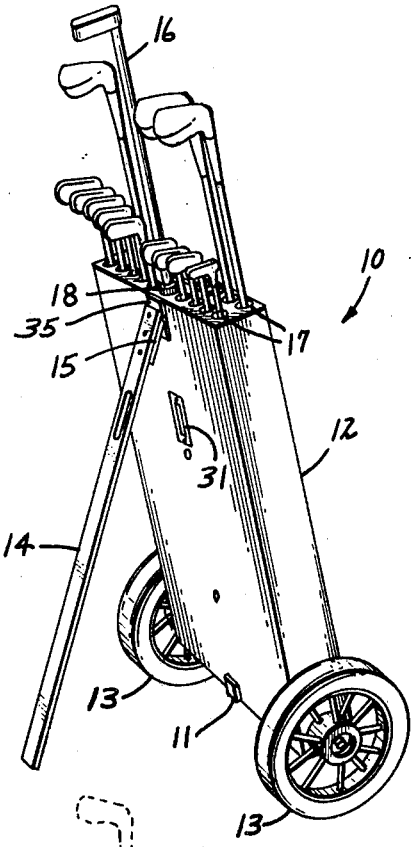
FIG. 1 is a view of the present invention in perspective.

Referring now to FIG. 1, there is shown a perspective view of the present invention in an operative condition. Golf cart 10 is provided with a lightweight durable body 12, which can be fabricated from plastic or other suitable material. Cart body 12 includes a plurality of recesses 17 integrally formed within the body and having openings at the top of the body for carrying a variety of golf clubs. The recesses are said to be integrally formed inasmuch as in the preferred embodiment the cart body is formed of molded plastic such that a unitary structure results with features, such as the club recesses, forming an integral part of the molded body. Further, when the cart body mold is designed, all excess plastic is evacuated to to provide a more lightweight body.

A handle 16 is provided to facilitate transporting the golf cart over the golf course. Handle 16, in this embodiment, is engaged within a recess in cart body 12 into which handle 16 is retractable. Locknut 18 is provided to lock the handle 16 in any desired position. A support strut 14 is shown as it is pivotally attached to hinge 15 of cart body 12. Support strut 14 is long enough to support the cart, when standing, in a substantially upright position. A strut locking device 11, which can be magnetic for example, is provided to secure strut 14 to cart body 12 when the cart is in the storage position. Cart body 12 is further provided with a storage hanging means 31 which is integrally formed within the cart body 12. The detachable wheels 13 are positioned on either side of the lower portion of the cart and are readily removed by a snapping action, described in greater detail below.

Figure 2:
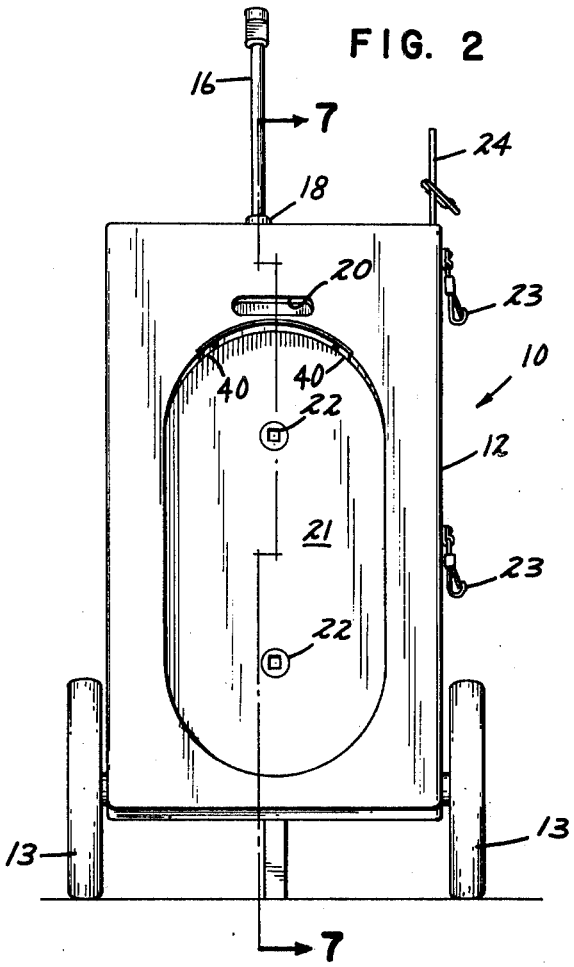
FIG. 2 is a front elevation of the present invention in an operational position.
Figure 8:
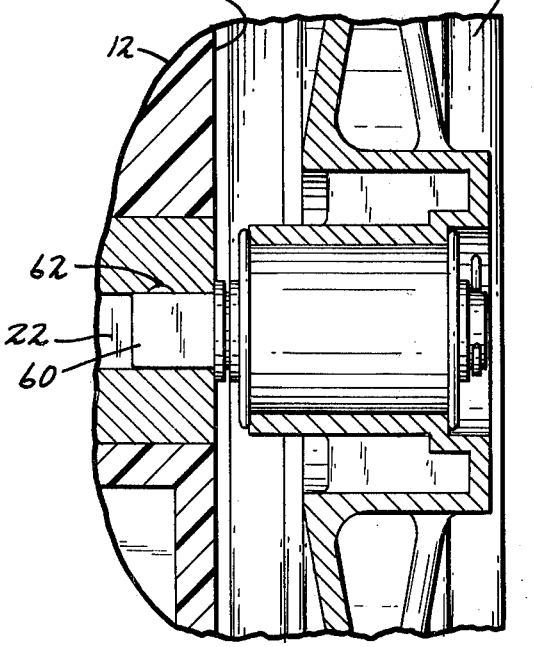
FIG. 8 is an enlarged sectional view as seen from the line 8—8 of FIG. 6.

Referring now to FIG. 2, thre is shown a frontal elevation of the present invention in an operative position. Cart body 12 includes a recess 21 for carrying detachable wheels 13 when the cart is in the storage condition. A ball detent connection is utilized to provide snap-action attachment and detachment of wheels 13. The ball detent connection, as formed within the recess 21 of body 12, includes the female member 22 of the connection and is engageable with the male member of the connection 60 on wheel 13, as shown in FIG. 8. Cart body 12 is further provided with a hand grip 20 which is a recess formed within the body 12. A carrying strap 24 is shown in its storage position within cart body 12 and carrying strap snaps 23 are provided thereon.

Figure 3:
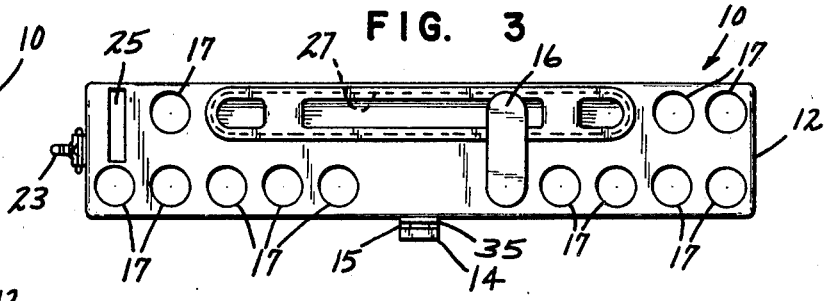
FIG. 3 is a top plan view of the present invention in a storage position.

Referring now to FIG. 3, there is shown a top plan view of the present invention. Club recesses 17 are provided therein and are sized to facilitate insertion of any standard golf club. A golf tee storing recess 27 is formed within body 12 and provides a readily accessible storage area for other small equipment. Cart body 12 also includes gold ball dispensers 26. Ball dispensers 26 are similarly formed as recesses within cart body 12. A carrying strap recess 25 is provided for convenient carrying of the strap while not in use.

Figure 4:
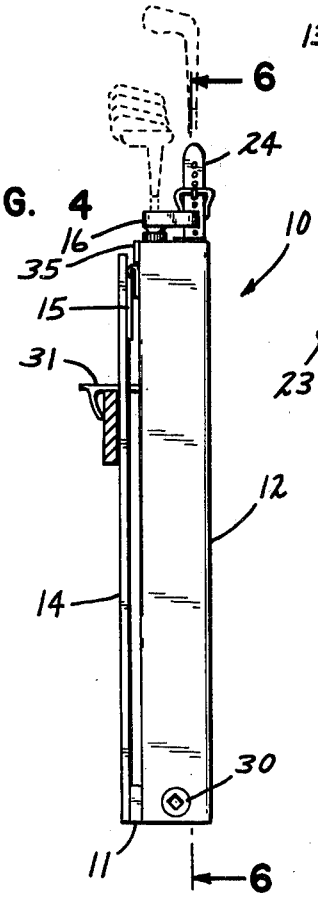
FIG. 4 is a side elevational view thereof in a storage position.

FIG. 4 is a side elevational view of the present invention in a storage position. Handle 16 is shown in its retracted position and is locked into place by locknut 18. Support strut 14 is retracted to engage support lock 11 and hanging means 31 is shown in its extended position. Detachable wheels 13 have been removed exposing the female end 30 of another ball detent connection. The ball detent connection means, as shown here, is similar to that utilized by a socket wrench an its interchangeable sockets.

Figure 5:
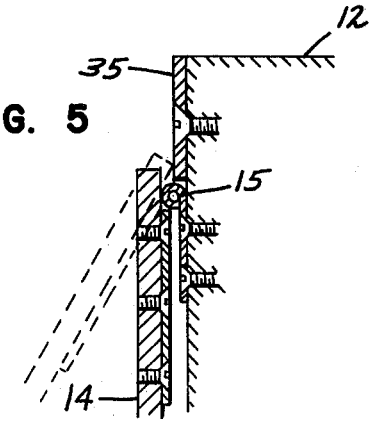
FIG. 5 is a sectional view, on an enlarged scale, of a portion of FIG. 1.

FIG. 5 is a sectional view showing support strut 14 in its storage position. Support strut 14 is attached to cart body 12 by hinge 15. A reinforcing plate 35 is provided for support strut 14 when it is in its extended position.

Figure 6:
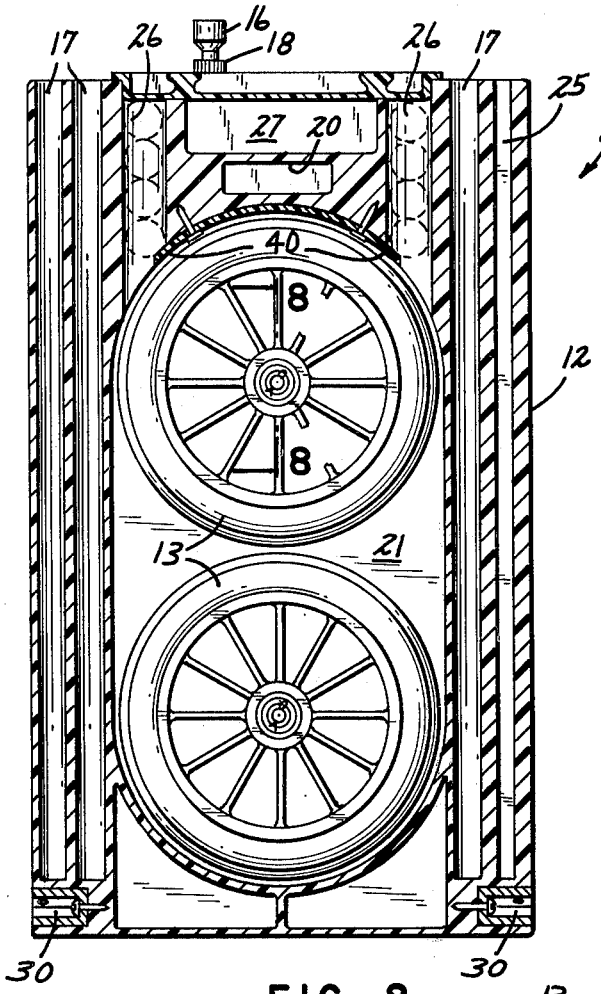
FIG. 6 is a vertical section as seen from the line 6—6 of FIG. 4.

Referring now to FIG. 6, the cart 10 is shown in its storage condition. Wheels 13 have been snapped out of the female end 30 of the ball detent connection and have been snapped into wheel recess 21 of the cart body 12. Golf club recesses 17 are shown as they extend throughout the length of body 12. Carrying strap recess 25 is similarly shown. The golf tee storage recess 27 is also shown in section. Golf ball dispenser 26, which is formed in a recess of body 12 is provided with a flexible restraining member 40 such that one or more balls with pass from dispenser 26 into the opening at the upper portion of wheel storage recess 21. Flexible restraining member 40 can be formed of resilient plastic, a thin metal leaf spring, or any other suitable means, and can be secured to cart body 12 by bolting, or can be formed as an integrated part of cart body 12.

Figure 7:
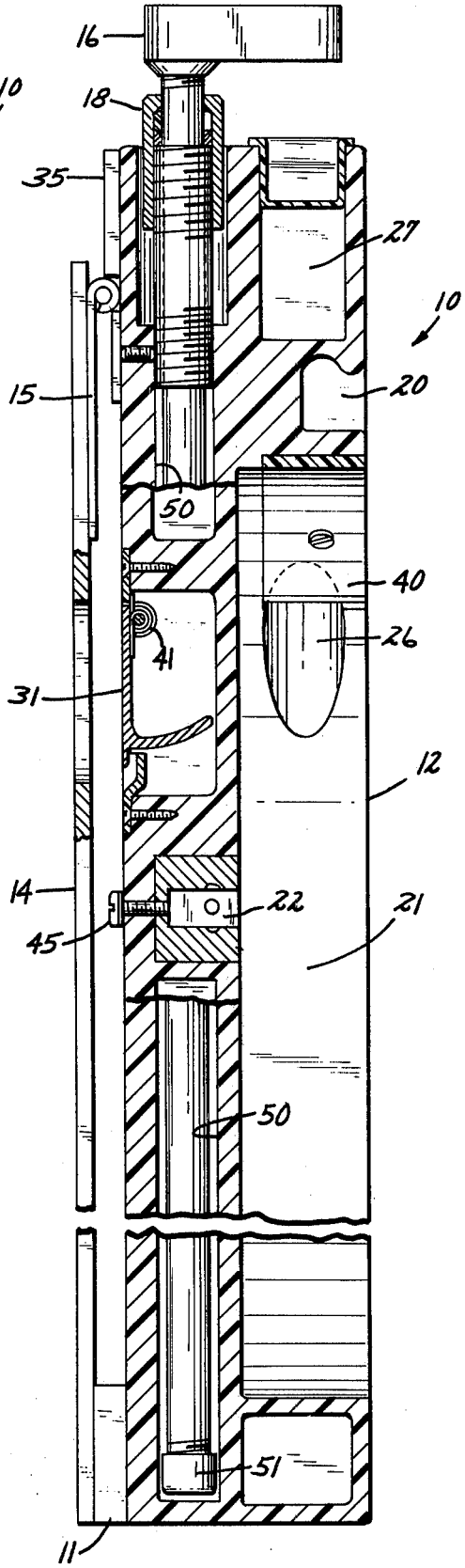
FIG. 7 is a view in vertical section along the line 7—7 of FIG. 2, portions thereof broken away.

Referring now to FIG. 7, there is shown a cross-sectional view off the present invention in a storage condition. Handle 16 is fully retracted within handle recess 50. Locknut 18 is shown as a threaded locking nut similar to that used to secure telescoping members. At the bottom of handle 16 a lockout cap 51 is provided to prevent handle 16 from being completely extracted from cart body 12.

Also in cross section, a portion of flexible restraining member 40 is shown as it appears in relation to the recess 21 of cart body 12. The female end 22 of a ball detent connection is shown as it is secured within cart body 12 by bolt 45. Any of the ball detent connection members can be secured to the cart body by bolting or in any other suitable manner such as gluing. Hanging means 31 is shown in its retracted position within its corresponding recess in cart body 12. The storage hook 31 is attached to cart body 12 by hinge 41.

Referring now to FIG. 8, a detachable wheel 13 is shown as it is engaged to the ball detent connection in recess 21. The male member 60 of the ball detent connection on wheel 13 is described by an extension member with spring-biased catch ball 62. The female end of a ball detent connection forms a corresponding receptacle into which male member 60 is inserted and an indentation therein receives spring-biased catch ball 62 and thereby holds the male member securely to the female member. Removal of detachable wheel 13 can be effected by a snap-action motion pulling the male member from the female member of the ball detent connection. As stated previously, the ball detent connection members are similar to those utilized by socket wrenches.

Figure 9:
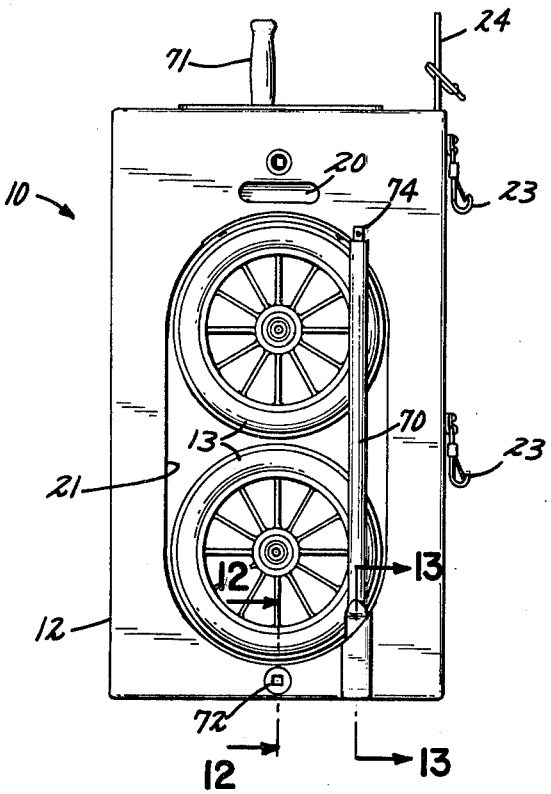
FIG. 9 is a front elevational view of an alternate embodiment of the present invention in a storage condition.

Referring now to FIG. 9, there is shown generally an alternative embodiment of the present invention in a storage condition. This embodiment provides a support strut 70 which is engageable with a ball detent connection female end 72 in the lower central portion of cart body 12. Support strut 70 is shown as it is engaged with a sleeve 73 formed on cart body 12 in a storage position. The opposite end of support strut 70 includes the male member 74 of a ball detent connection which is engageable with the female end 72.

Figure 10:
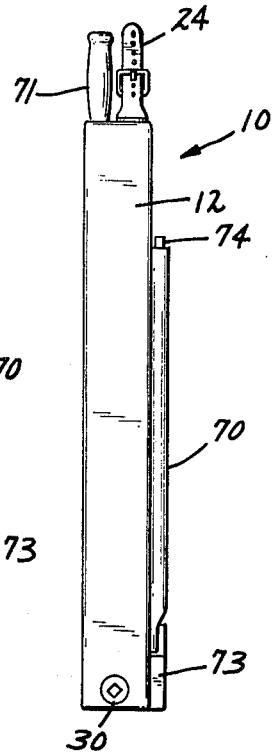
FIG. 10 is a side elevational view as seen from left to right of FIG. 9.

FIG. 10 shows support strut 70 from a side elevation as it is engaged within sleeve 73 of cart body 12. The support strut 70 has a tapered portion which facilitates a secure attachment to sleeve 73.

Figure 11:
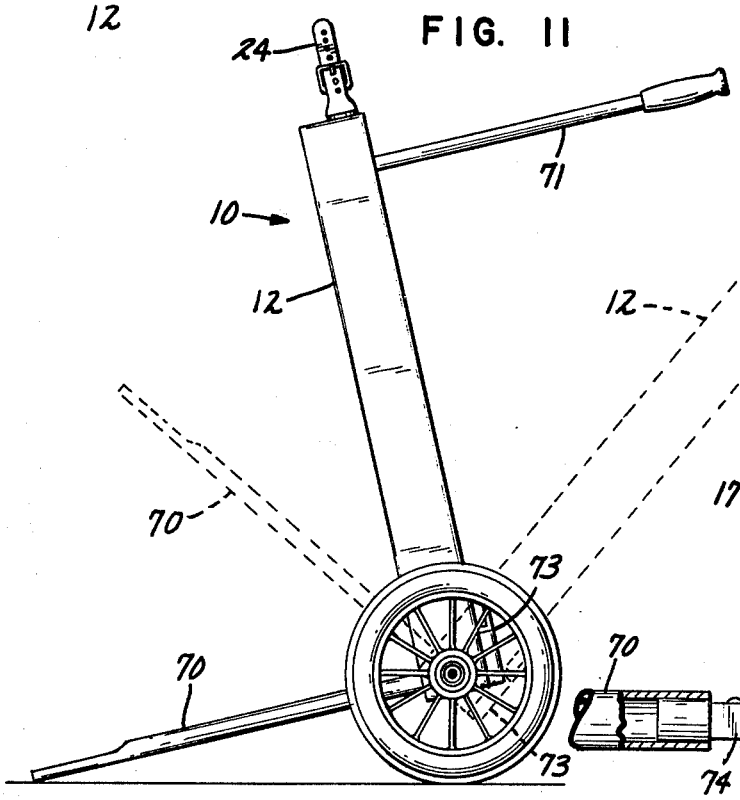
FIG. 11 is a side elevational view, similar to FIG. 10, showing an operative position of the alternative embodiment of the present invention.

Referring now to FIG. 11, support strut 70 is shown in an operating position as it is secured to the lower portion of cart body 12. Support strut 70 is of sufficient length to support cart body 12 in a substantially upright position. This embodiment of the present invention also includes a detachable handle 71 which is engageable with the cart body utilizing another ball detent connection, not shown. In a storage condition, handle 71 would be removed and can be inserted into any vacant golf club recess 17, or can be stored similarly to strut 70.

Figure 12:
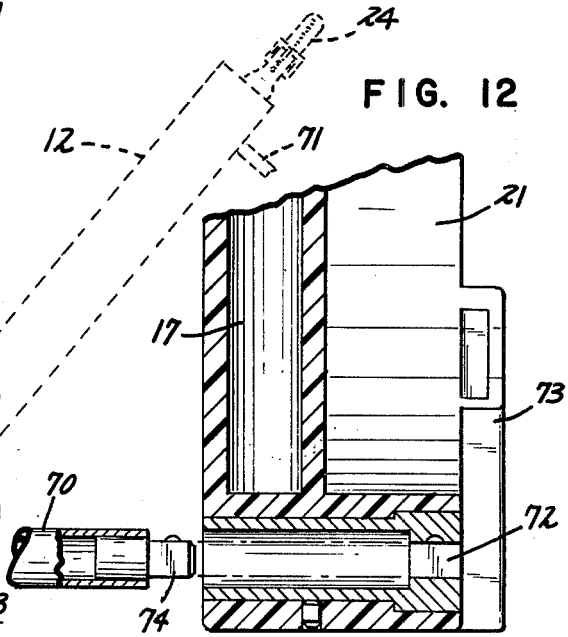
FIG. 12 is an enlarged sectional view of the present invention as seen along line 12—12 of FIG. 9.

Referring now to FIG. 12, there is shown an enlarged view of the engagement of the ball detent connection female end 72 and the male member 74 on support strut 70. This connection is the same type utilized on the cart body for the detachable wheels.

Figure 13:
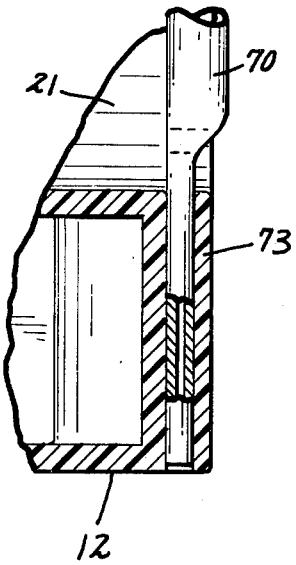
FIG. 13 is an enlarged sectional view as seen from the line 13—13 of FIG. 9.

Referring now to FIG. 13, there is shown a more detailed view of the engagement of strut 70 with the sleeve 73 of cart body 12, showing the engagement of the tapered portion of strut 70 with strut sleeve 73.

It will be apparent that various changes and modifications in the illustrative embodiments of the invention, shown and described herein, can be made without departing from the scope of the invention as defined in the appended claims.

What is claimed is:

1. A convertible golf cart, comprising:

a. a cart body formed of a durable plastic material having a plurality of integrated recesses formed therein being sized to accommodate the handle and shaft of a golf club;

b. a pair of detachable wheels;

c. means for engaging and disengaging said wheels and said cart in an operating position;

d. means carried on an exterior surface of said cart body and on said wheels for engaging and disengaging said wheels and said cart in a storage position;

e. means for supporting said cart in a substantially upright position; and f. a handle being movable from an operating position to a storage position in which said means for engaging and disengaging said wheels and said cart comprises a plurality of female members of a ball detent connection being positioned on either side of the bottom of said cart in an operating position and a plurality of female members being positioned within a wheel storge recess formed in an exterior surface of said body and including male members of a ball detent connection, engageable with each of said female members, being positioned on each of said wheels.

2. The convertible golf cart of claim 1 in which said means for supporting said cart in a substantially upright position comprises a strut member which is pivotally hinged to said cart body at the upper portion thereof and which is engageable with a locking member on the lower portion of said cart when said cart is in a storage position, the length of said strut member being generally equal to the length of said cart body.

3. The convertible gold cart of claim 1 in which said cart body includes an integrated recess for storing golf tees and small equipment.

4. The convertible golf cart of claim 1 in which said cart body includes at least one integrated ball dispenser formed in said body, said dispenser being adapted to deliver one golf ball at a time to the golfer.

5. The convertible golf cart of claim 1 in which said cart body includes an integrated means for hanging said cart body in a storage condition.

* * * * *

UNITED STATES PATENT AND TRADEMARK OFFICE

CERTIFICATE OF CORRECTION

PATENT NO. : 4,017,091
DATED : April 12, 1977
INVENTOR(S) : Russell J. Wallen

It is certified that error appears in the above-identified patent and that said Letters Patent are hereby corrected as shown below:

Column 1, line 49, change the word "gold" to the word --golf--.

be deleted.

Column 2, line 51, change the word "thre" to the word --there--.

Column 3, line 4, change the word "gold" to the word --golf--.

Column 3, line 16, change the word "an" to the word --and--.

Column 3, line 39, change the word "off" to the word --of--.

Column 4, line 64, change the word "storge" to the word --storage--.

UNITED STATES PATENT OFFICE

CERTIFICATE OF CORRECTION

Patent No. 4,017,091 Dated April 12, 1977

Inventor(s) Russell J. Wallen

It is certified that error appears in the above-identified patent and that said Letters Patent are hereby corrected as shown below:

Column 6, line 1, "gold" should read -- golf --.

Signed and Sealed this

Thirtieth Day of May 1978

[SEAL]

Attest:

RUTH C. MASON
Attesting Officer

LUTRELLE F. PARKER
Acting Commissioner of Patents and Trademarks